US005584748A

United States Patent [19]

Flynn et al.

[11] Patent Number: 5,584,748

[45] Date of Patent: Dec. 17, 1996

[54] BLAST WHEEL HAVING A ROTATABLE SHAFT WITH RADIAL DISCS AND BLADES DOVETAILED ACROSS THE DISCS

[75] Inventors: Kevin R. Flynn, Piedmont, Okla.; Frank T. Battles, Jacksonville, Fla.

[73] Assignee: Nelco Manufacturing Corp., Oklahoma City, Okla.

[21] Appl. No.: 370,711

[22] Filed: Jan. 10, 1995

[51] Int. Cl.[6] ..... B24C 5/00

[52] U.S. Cl. ..... 451/91; 451/98; 451/97

[58] Field of Search ..... 457/91, 94, 95, 457/97, 98, 92; 451/541, 449; 299/39.3

[56] References Cited

U.S. PATENT DOCUMENTS

| | | | |
|---|---|---|---|
| 923,100 | 5/1909 | Young . | |
| 2,159,051 | 5/1939 | Quinn | 51/9 |
| 2,204,610 | 6/1940 | Minich et al. | 51/9 |
| 2,254,234 | 9/1941 | Minich | 51/9 |
| 3,034,262 | 5/1962 | Pawlson | 51/9 |
| 3,162,983 | 12/1964 | Hartman | 451/98 |
| 3,262,228 | 7/1966 | Schenck | 51/9 |
| 3,788,010 | 1/1974 | Goff | 51/9 |
| 3,900,969 | 8/1975 | Diehn | 51/9 |
| 3,934,372 | 1/1976 | Diehn et al. | 51/8 SR |
| 3,934,373 | 1/1976 | Leliaert et al. | 51/9 M |
| 3,977,128 | 8/1976 | Goff | 51/9 M |
| 4,020,596 | 5/1977 | Bergh | 51/9 M |
| 4,164,104 | 8/1979 | Carpenter et al. | 451/97 |
| 4,364,823 | 12/1982 | Goff | 209/135 |
| 4,376,358 | 3/1983 | Shelton | 51/429 |
| 4,377,923 | 3/1983 | Bergh | 51/424 |
| 4,377,924 | 3/1983 | Bergh | 51/429 |
| 4,416,092 | 11/1983 | Nelson | 51/425 |
| 4,932,167 | 6/1990 | Carpenter | 51/433 |
| 4,941,296 | 7/1990 | Carpenter | 51/433 |
| 5,257,480 | 11/1993 | Carpenter | 451/98 |
| 5,269,355 | 12/1993 | Bowen | 299/39.3 |

FOREIGN PATENT DOCUMENTS

| | | |
|---|---|---|
| 0032161 | 7/1981 | European Pat. Off. . |
| 2900 | of 1870 | United Kingdom . |
| 2203368 | 10/1988 | United Kingdom . |

OTHER PUBLICATIONS

Marks's Standard Handbook for Mechanical Engineers, 8th Edition, section 12–139, Noise Control 1951.

*Primary Examiner*—Bruce M. Kisliuk
*Assistant Examiner*—George Nguyen
*Attorney, Agent, or Firm*—Dunlap & Codding, P.C.

[57] ABSTRACT

A blast wheel having a rotatable shaft with discs carrying blades for propelling abrasive material against a surface to be blast-cleaned. Each one of the blades has a striking portion and a dovetail base member. Each one of the discs has a number of circumferential dovetail slots for receiving the base members of the blades. Keeper plates, lock washers and keeper bolts are used to retain each end of each blade in place. Each disc has several sound-abating holes to reduce the rotational noise of the blast wheel.

12 Claims, 3 Drawing Sheets

BLAST WHEEL HAVING A ROTATABLE SHAFT WITH RADIAL DISCS AND BLADES DOVETAILED ACROSS THE DISCS

BACKGROUND OF THE INVENTION

1. Field of the Invention

The present invention relates generally to devices for blast-cleaning surfaces and particularly, but not by way of limitation, to a rotatable blast wheel for propelling abrasive material against a surface to be blast-cleaned.

2. Description of Related Art

Several types of blast wheels have been used in blast-cleaning machines over the years. One type of blast-wheel is disclosed in U. S. Pat. No. 4,377,924 issued to Bergh. This particular device is called a "centrifugal blasting wheel" or a "center feed throwing wheel." Abrasive material is fed to a cage in the center of the wheel, which has a hub and a number of blades extending radially outward from the hub. The cage dispenses abrasive material to the blades, which throw the abrasive material in a direction controlled by the cage.

The Bergh device is subject to wear with respect to the cage, the hub and the blades. Thus, the capability of the Bergh blast wheel to center feed and throw abrasive material is bought at the cost of additional components being subjected to wear and ultimate replacement.

Another type of blast wheel is sometimes called a "paddle wheel", the construction of which is disclosed in U.S. Pat. No. 4,416,092 issued to Nelson. This wheel has a drum and a number of blades extending radially outward from the drum. Abrasive material is fed generally along a tangent to the drum and the blades strike the abrasive material toward the surface to be blast-cleaned as the drum is rotated.

The Nelson blast wheel is simpler in construction than the center feed throwing wheel. However, the striking action of the paddle wheel blades is noisier than the throwing operation of the centrifugal wheel. Further, the drum construction of the Nelson blast wheel augments the noise created by the paddle wheel blades.

SUMMARY OF THE INVENTION

The present invention is a "paddle wheel" type of blasting wheel and comprises a rotatable shaft with a plurality of discs extending radially from the shaft and a plurality of blades mounted across the discs.

One object of the present invention is to provide a blast wheel with construction sturdy enough to stand up to the most demanding blast-cleaning job.

Another object of the present invention is to provide a blast wheel with blades which are easily removed and installed.

Yet another object of the present invention is to provide a blast which is less noisy than conventional paddle wheels.

Other objects, features and advantages of the present invention are apparent from the following detailed description when read in conjunction with the accompanying drawings and appended claims.

DETAILED DESCRIPTION OF THE PREFERRED EMBODIMENTS

Figure 1:
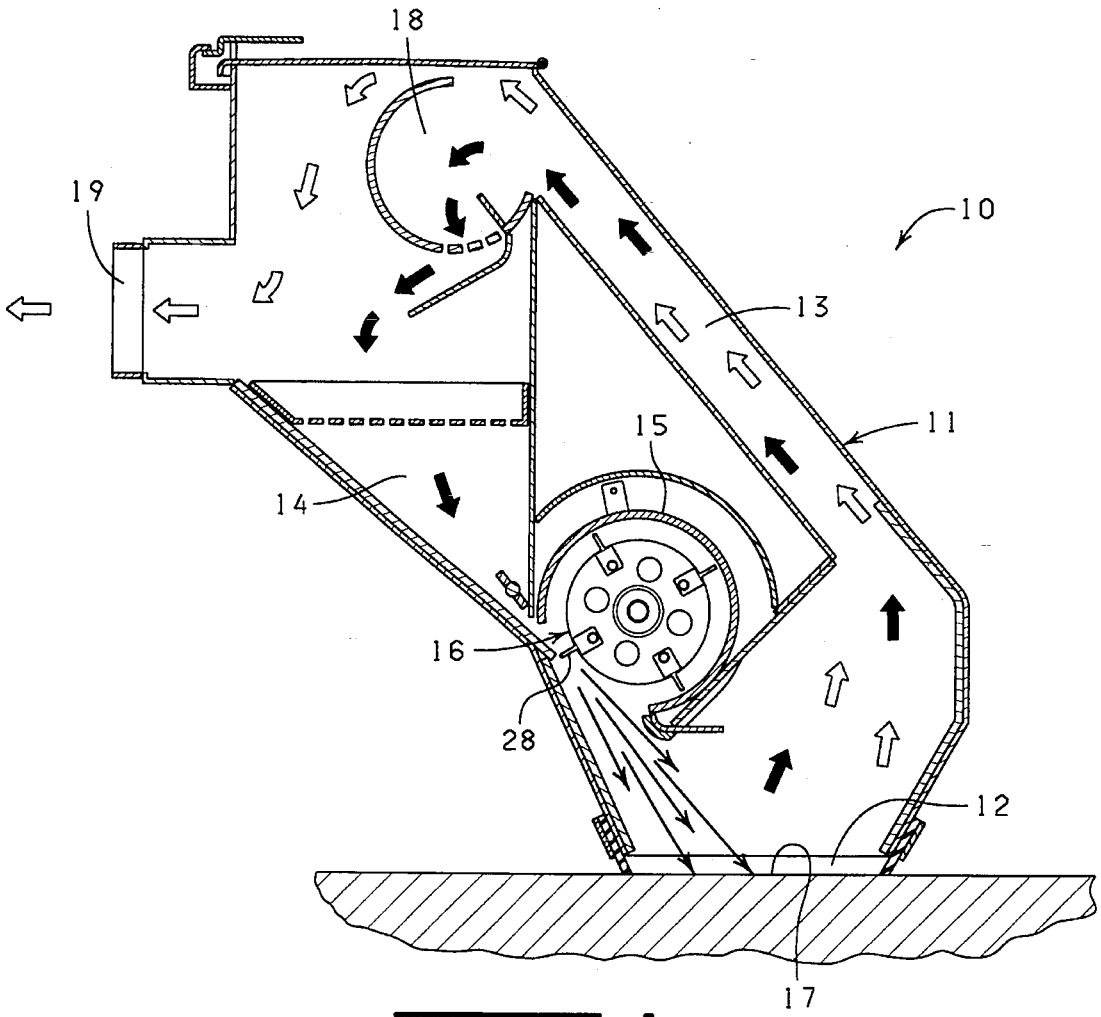
FIG. 1 is a partly sectional, partly diagrammatical view of a blast-cleaning machine with a blast wheel constructed in accordance with the present invention.

Referring to the drawings in general, and to FIG. 1 in particular, shown therein and designated by the general reference numeral 10 is a blast cleaning machine. In FIG. 1, the travel path of abrasive material is indicated in solid arrows and the movement of air and dust is designated by hollow arrows.

The machine 10 includes a housing 11 with a blast opening 12, a return corridor 13, a hopper 14 and a blast housing 15. A blast wheel 16 is mounted within the blast housing 15 for rotation to propel abrasive material through the blast opening 12 and against a surface 17 to be cleaned.

A collection chamber 18 is provided in the upper end of the housing 11 to receive spent abrasive material, dust and air from the return corridor 13. The housing 11 includes a dust conduit 19 for attachment of a dust collection (not shown) to remove dust and light-weight debris from the machine 10. Typical construction of the blast cleaning machine 10, with the exception of the blast wheel 16, is disclosed in U.S. Pat. No. 5,205,084, which is hereby incorporated by reference.

Figure 2:
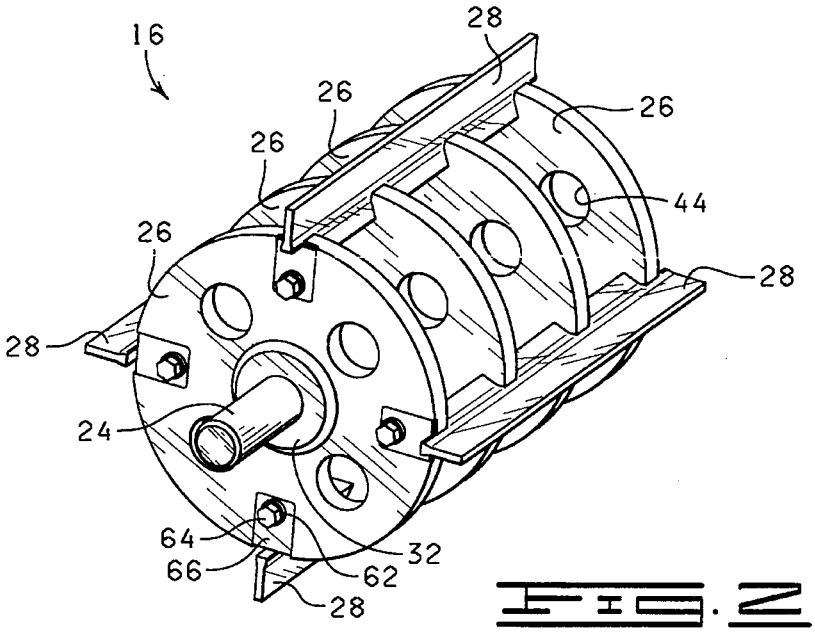
FIG. 2 is a perspective view of a blast wheel constructed in accordance with the present invention.

With reference to FIG. 2, shown therein is the blast wheel 16 separate from the blast cleaning machine 10. The blast wheel 16 includes a rotatable shaft 24 and a plurality of radial discs 26 affixed to the shaft 24. In a typical arrangement, four discs 26 extend radially from the shaft 24. However, it should be appreciated that any number of discs 26 consistent with the purpose and use disclosed herein may be provided.

Typically, four blades 28 are mounted across the discs 26 for striking abrasive material as the shaft 24 is rotated. However, it should be appreciated that less than four blades 28, or more than four blades 28, may be attached to the discs 26 without departing from the scope and purpose of the present invention. The construction for the mounting of the blades 28 to the discs 26 is described in detail hereinafter.

Figure 3:
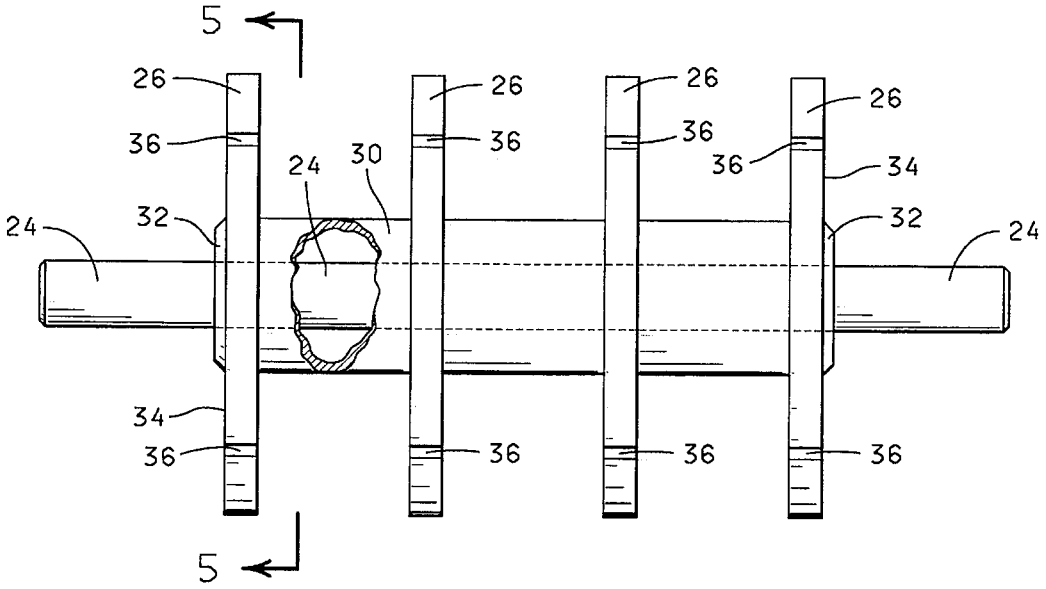
FIG. 3 is a side elevation of the shaft and radial discs of the blast wheel shown in FIG. 2. An intermediate area of the shaft is cut away to illustrate the internal structure of the shaft.

As best shown in FIG. 3, the discs 26 extend radially from the shaft 24 in an equally spaced arrangement. The discs 26 have substantially the same size, shape and weight and are positioned such that the shaft 24 has balanced rotation about its longitudinal axis.

Between the two outermost discs 26, an outer tubular shaft 30 extends axially through the discs 26, substantially as shown in FIG. 3. The discs 26 are welded, or affixed in any other suitable manner, to the tubular shaft 30.

A pair of end plates 32 are provided to secure the shafts 24 and 30 and the discs 26 together. Each end plate 32 may be welded or otherwise suitably affixed to the shaft 24 and the outside surface 34 of the corresponding outermost disc 26, substantially as shown in FIGS. 3 and 4.

Figure 4:
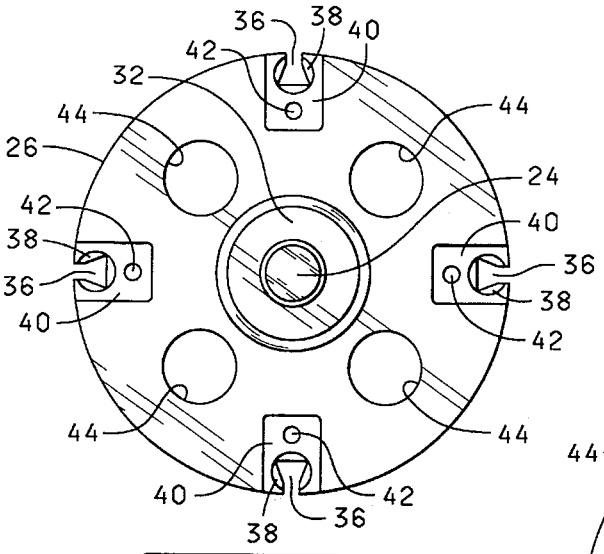
FIG. 4 is an end elevation of the shaft and radial discs shown in FIG. 3.
Figure 5:
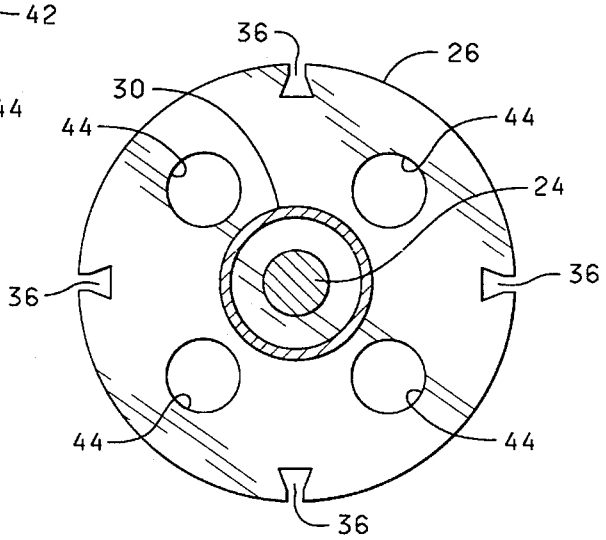
FIG. 5 is a sectional view taken along the lines 5—5 of FIG. 3.

As illustrated by FIGS. 4 and 5, the discs 26 are basically circular plates which are centered on the shafts 24 and 30. Each disc 26 typically has four circumferential dovetail slots 36. Each slot 36 is provided for the mounting of one of the blades 28 to the disc 26. It should be appreciated that the number and position of circumferential slots 36 in each disc 26 should correspond to the number and position of the blades 28 for the particular blade arrangement selected for the blast wheel 16.

As illustrated by FIG. 4, the outer surface 34 of each outermost disc 26 has a boss recess 38, a keeper recess 40 and a keeper bolt-hole 42 corresponding to each circumferential slot 36. As shown in FIG. 5, the inner surface of each outside disc 26 need not have the boss recesses 38, the keeper recesses 40 or the keeper bolt-hole 42. It should be appreciated that neither the inner nor the outer surfaces of the inner discs 26 need have the boss recesses 38, the keeper recesses 40 or the keeper bolt-holes 42.

Blast-cleaning a surface is a noisy operation and it is desirable to reduce the noise level as much as possible. One component of the noise is the roar produced by the rotation of the blast wheel 16 itself. It has been found that the rotational noise of the present invention is substantially less than that of a drum-type blast wheel.

In order to reduce the rotational noise of the blast wheel 16 further, a plurality of sound-abating holes 44 may be provided through each one of the discs 26 substantially as shown in FIGS. 4 and 5. Typically, four equally sized, shaped and spaced circular sound-abating holes 44 are provided through each one of the discs 26. Further, the sound-abating holes 44 are typically centered between two adjacent circumferential slots 36 in each one of the discs 26. However, it should be appreciated that any suitable number, size, shape and spacing of sound-abating holes 44 may be utilized.

With reference to FIGS. 6 through 9, shown therein is one of the blades 28 separate from the blast wheel 16. Each one of the blades 28 is basically a flat, elongated plate having a first striking surface 46, an opposite second striking surface 48 and a base member 50.

Figure 6:
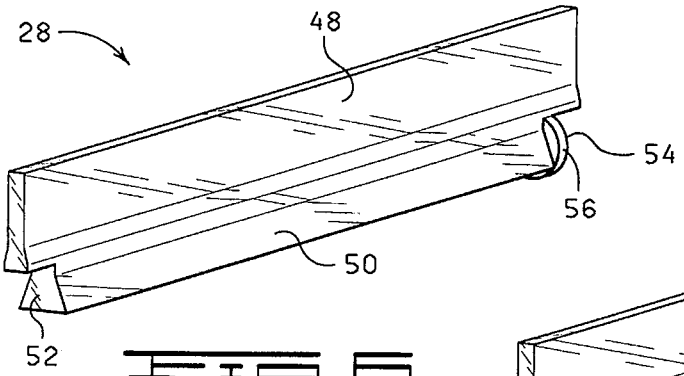
FIG. 6 is a perspective view of one of the blades of the blast wheel shown in FIG. 2 from the unbossed end of the blade.
Figure 7:
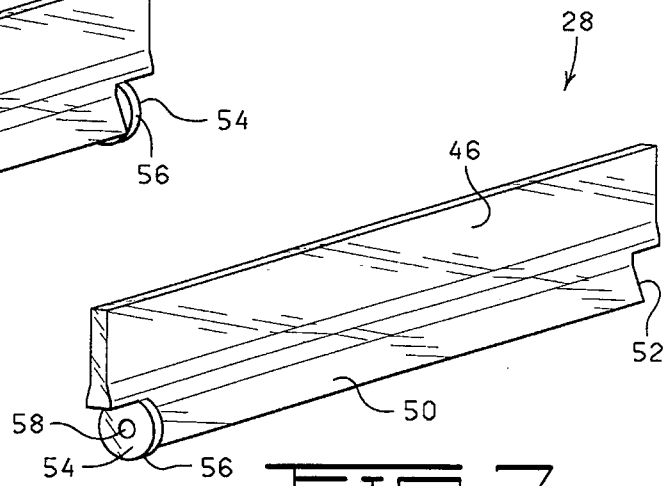
FIG. 7 is a perspective view of the blade shown in FIG. 6 from the bossed end of the blade.
Figure 8:
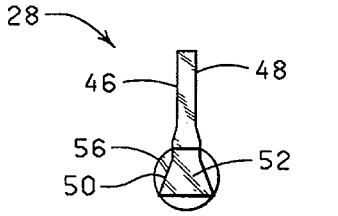
FIG. 8 is an elevational view of the unbossed end of the blade shown in FIG. 6.
Figure 9:
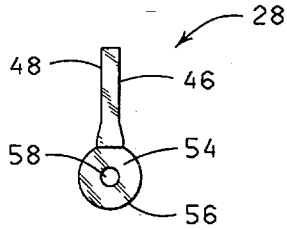
FIG. 9 is an elevational view of the bossed end of the blade shown in FIG. 6.

As best seen in FIGS. 6 and 8, the base member 50 has a substantially dovetail shape in order to matingly fit into the circumferential slots 36 of the discs 26. Further, the base member 50 has an unbossed end 52 and a bossed end 54. The bossed end 54 includes a boss 56 which extends beyond the outer periphery of the dovetail portion of the base member 50, substantially as shown in FIGS. 8 and 9.

Typically, the boss 56 is cylindrical in shape. However, it should be appreciated that the boss 56 may have any suitable shape which extends beyond the outer periphery of the dovetail portion of the base member 50. It should also be appreciated that the boss 56 of each blade 28 is sized and shaped to fit within any of the boss recesses 38 of the outer discs 26. A threaded bore 58 is provided in the boss 56 of the base member 50 of each blade 28.

Figure 10:
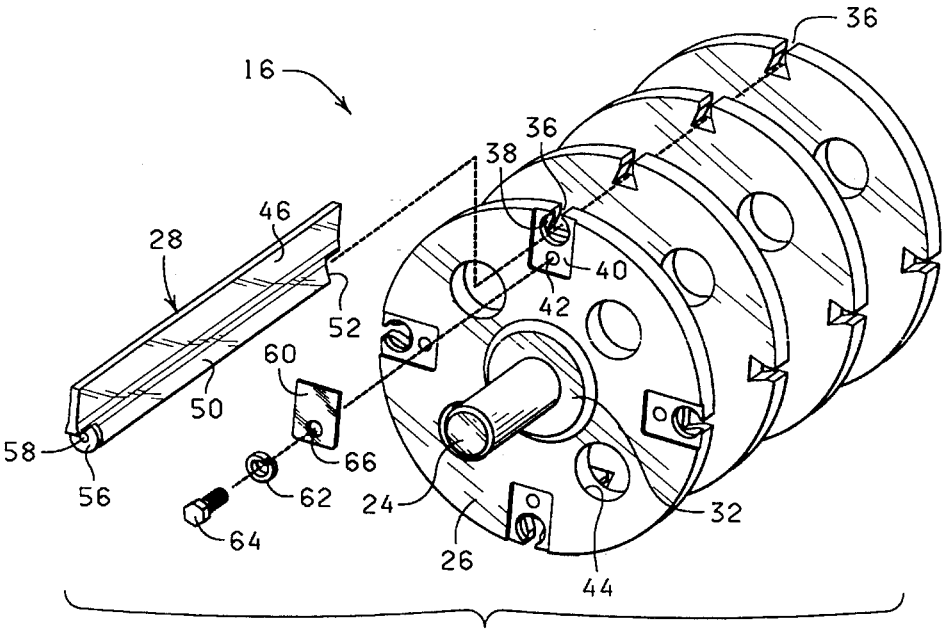
FIG. 10 is an exploded perspective view of the blast wheel shown in FIG. 2.

Referring to FIG. 10, shown therein is an illustration of how the blades 28 are mounted to the discs 26 of the blast wheel 16. For simplicity, the mounting for only one blade 28 is shown in FIG. 10. It should be appreciated that all of the blades 28 are mounted to the discs 26 in substantially the same manner as the one shown in FIG. 10.

The base member 50 of the blade 28 is inserted, unbossed end 52 first, through the circumferential slots 36 of each of the discs 26. When fully inserted, the base member 50 of the blade 28 extends through a corresponding one of the circumferential slots 36 of each disc 26 and the boss 56 of the blade 28 is seated in the boss recess 38 of the outer disc 26.

A keeper plate 60, lock washer 62 and keeper bolt 64 are provided to retain the blade 28 in place. The keeper plate 60 has a keeper hole 66 through which the keeper bolt 64 is inserted. The keeper plate 60 is seated within the keeper recess 40 of the outer disc 26. Then, the keeper bolt 64 is inserted through the lock washer 62 and keeper hole 66 and threaded into the bolt hole 42 of the outer disc 26 substantially as shown in FIG. 10.

It should be appreciated that another keeper plate 60, lock washer 62 and keeper bolt 64 assembly may be provided at the opposite outer disc 26. Alternatively, the opposite outer disc 26 may be provided with a permanent keeper plate 60, which is welded or otherwise affixed to the disc 26.

In another embodiment, the opposite outer disc 26 may be constructed with a circumferential slot, similar to the circumferential slots 36, but extending only partly across the disc 26 from the inside surface of the disc 26. In this manner, the disc 26 itself abuts the unbossed end 52 of the base member 50 to hold the blade 28 in place.

The embodiments just described provide an important safety feature. As blades become worn, they need to be replaced before they break. If the user of the blast wheel 16 is able to turn the blades around, he may be tempted to do so in order to prolong his use of the blade. However, if the blades 28 have been worn on the first striking surface 46, it is a safety risk to use the second striking surface 48 of the blades 28.

Accordingly, the boss 56 of the blade base 50 allows insertion of the blade 28 in only one orientation. This prevents the user from turning the blades 28 around and creating a safety hazard by using worn blades.

It should be appreciated that the blades 28 are readily removed and replaced. The threaded bore 58 in the boss 56 of each blade 28 is provided for attachment of a slide hammer should the blades 28 require some coaxing in order to be removed from the blast wheel 16.

Changes may be made in the combinations, operations and arrangements of the various parts and elements described herein without departing from the spirit and scope of the invention as defined in the following claims.

What is claimed is:

1. A blast wheel for propelling abrasive material against a surface to be blast-cleaned, the blast wheel comprising:

a rotatable shaft having a longitudinal axis;

a plurality of spaced-apart discs extending radially from the shaft;

a plurality of blades transversely mounted to the discs to extend outwardly from the discs, each one of the blades having a striking surface for propelling abrasive material toward a surface to be blast-cleaned as the shaft is rotated about its longitudinal axis; and wherein each one of the discs has a plurality of circumferential slots and each one of the blades has a based shaped to mate with the slots of the discs, wherein the blades are mounted to the discs by disposing the base of each one of the blades in a corresponding slot of each one of the discs, and wherein the base of each one of the blades has a boss end with a boss sized and shaped to prevent inserting the blade boss end first into the slots of the discs.

2. The blast wheel of claim 1 wherein the blades extend radially from the discs.

3. The blast wheel of claim 1 wherein each one of the discs has a plurality of sound-abating holes therethrough.

4. The blast wheel of claim 1 wherein each one of the slots has a dovetail shape.

5. The blast wheel of claim 1 further comprising: means for securing each one of the blades to the discs.

6. The blast wheel of claim 5 wherein the means for securing comprises:

a plurality of keeper plates; and means for attaching each one of the keeper plates to one of the discs such that the keeper plates retain the blades in the slots of the discs.

7. A blast wheel for propelling abrasive material against a surface to be blast-cleaned, the blast wheel comprising:

a rotatable inner shaft having a longitudinal axis;

a tubular outer shaft circumscribing an intermediate portion of the inner shaft, the outer shaft being secured to the inner shaft such that the outer shaft rotates in response to rotation of the inner shaft;

a plurality of spaced-apart discs extending radially from the outer shaft; and a plurality of blades transversely mounted to the discs to extend outwardly from the discs, each one of the blades having a striking surface for propelling abrasive material toward a surface to be blast-cleaned as the inner shaft is rotated about its longitudinal axis;

wherein each one of the discs has a plurality of circumferential slots and each one of the blades has a base shaped to mate with the slots of the discs, wherein the blades are mounted to the discs by disposing the base of each one of the blades in a corresponding slot of each one of the discs, and wherein the base of each one of the blades has a boss end with a boss sized and shaped to prevent inserting the blade boss end first into the slots of the discs.

8. The blast wheel of claim 7 wherein the blades extend radially from the discs.

9. The blast wheel of claim 7 wherein each one of the discs has a plurality of sound-abating holes therethrough.

10. The blast wheel of claim 7 wherein each one of the slots has a dovetail shape.

11. The blast wheel of claim 7 further comprising: means for securing each one of the blades to the discs.

12. The blast wheel of claim 11 wherein the means for securing comprises:

a plurality of keeper plates; and means for attaching each one of the keeper plates to one of the discs such that the keeper plates retain the blades in the slots of the discs.

* * * * *